US005177461A

United States Patent [19]

Budzyna et al.

[11] Patent Number: 5,177,461

[45] Date of Patent: Jan. 5, 1993

[54] WARNING LIGHT SYSTEM FOR USE WITH A SMOKE DETECTOR

[75] Inventors: W. James Budzyna, Whitinsville; William A. Johnson, Holliston; David J. Howe, Milford, all of Mass.

[73] Assignee: Universal Electronics Inc., Peninsula, Ohio

[21] Appl. No.: 784,613

[22] Filed: Oct. 29, 1991

Related U.S. Application Data

[63] Continuation of Ser. No. 276,654, Nov. 28, 1988, abandoned.

[51] Int. Cl.[5] ..... G08B 1/08

[52] U.S. Cl. ..... 340/331; 340/539; 340/691; 340/628; 340/332; 340/815.11; 40/457

[58] Field of Search ..... 340/539

[56] References Cited

U.S. PATENT DOCUMENTS

| | | | |
|---|---|---|---|
| 3,810,170 | 5/1974 | Zinsmeister | 340/331 |
| 3,913,092 | 10/1975 | Klingenberg | 340/332 |
| 4,160,246 | 7/1979 | Martin et al. | 340/630 |
| 4,258,291 | 3/1981 | Scott et al. | 315/156 |
| 4,297,677 | 10/1981 | Lewis et al. | 340/566 |
| 4,417,235 | 11/1983 | Del Grande | 340/628 |
| 4,514,725 | 4/1985 | Bristley | 340/691 |
| 4,524,304 | 6/1985 | Todd | 315/156 |
| 4,531,114 | 7/1985 | Topol et al. | 340/628 |
| 4,570,155 | 2/1986 | Skarmen et al. | 340/531 |
| 4,612,535 | 9/1986 | Sequin et al. | 340/628 |
| 4,630,248 | 12/1986 | Scott | 340/566 |
| 4,633,234 | 12/1986 | Gagnon | 340/566 |
| 4,730,184 | 3/1988 | Bach | 340/691 |
| 4,736,186 | 4/1988 | Jones | 340/331 |
| 4,763,115 | 8/1988 | Cota | 340/628 |

*Primary Examiner*—Edward L. Coles, Sr.
*Assistant Examiner*—Jill Jackson
*Attorney, Agent, or Firm*—Thomas R. Vigil

[57] ABSTRACT

A flashing alarm device responsive to audible signals produced by a smoke detector when the smoke detector senses a smoke condition, the alarm device including a circuit with a microphone portion for responding to audible signals produced by the smoke detector and an amplifier circuit portion for amplifying signals produced by the microphone, a switch circuit portion having a control input connected to the output of the amplifier circuit portion, and another circuit portion including a battery, a timer circuit, and a light bulb, the battery having a connection to the amplifier circuit and to the timer circuit, the timer circuit and the light bulb being connected in series with the switch circuit portion for energizing and de-engergizing the light bulb whenever the switch circuit portion is in its conducting condition. The device may also include a housing for the components and the device may optionally be constructed to operate on transmitted and received radio frequency signals.

18 Claims, 2 Drawing Sheets

WARNING LIGHT SYSTEM FOR USE WITH A SMOKE DETECTOR

This is a continuation of application Ser. No. 07/276.654 filed Nov. 28. 1988 now abandoned.

The present invention relates to a smoke detector/-warning light system. and more particularly. to a device that includes a light source for mounting in a window or at some other highly visible location near where a smoke alarm is located so that if the smoke alarm activates due to detecting smoke or fire and produces audible signals. the light source will activate and produce light flashes to call attention to a room or rooms where persons may be located. hopefully so that a timely rescue can be undertaken. The present invention is especially useful as an aid in locating children. disabled persons and others in a building who may not be able to understand the need or be able to exit the building or may require assistance to exit.

Generally. a user of the present device will place it in a room where there is a smoke detector and where potential fire victims are located. such as a room where a child is sleeping. so that when the smoke detector emits an audible signal. the audible signal will activate a circuit associated with a light source of the present device to cause the light to begin to flash to let outsiders know where the dangers is and the most likely place where there are potential victims that may need help. The device can also be located where there are other items of value that need to be rescued. It can therefore be understood that the present device provides means to give a warning that is intended to identify where there is need for help in order to reduce the time required to get a rescue operation started.

Many devices have been constructed to alert occupants of a home or other buildings when smoke is detected and to give warning of such. Some of these have included well known smoke detector devices which are usually battery operated and when activated by smoke or fire. produce an easily recognizable alarm noise intended to alert persons who hear the noise of the dangerous condition that has been detected. There are also such devices which activate a light producing device to give a visual alarm.

One known form of such a smoke alarm warning device is disclosed in Skarman et al U.S. Pat. No. 4,570.155. This patent discloses a device that includes a portable light source for Producing emergency illumination of hallways and similar exit areas when a main power supply fails such as during a fire. The Skarman et al device includes a strobe circuit which periodically activates a detection circuit which responds accordingly to an occurrence of an audio smoke detector signal. Other known prior art devices of some interest are disclosed in Todd U.S. Pat. No. 4,524,304 and Scott et al U.S. Pat. No. 4,258,291. Neither of these patents disclose a system which not only alerts people to the presence of smoke or fire, but also provides a visible flashing warning which can be seen from outside the building where the smoke detector is located and which identifies a room or rooms where danger exists so that rescuers will know where first to go. The present invention fulfills this need in a novel and efficient manner and by means which include novel circuit means that are maintained in a continuous ready condition.

The present invention achieves these and other objectives in a system which continuously applies power to a light source activation circuit. which circuit also includes means that responds to audio noise or other signals produced by a smoke detector. When a smoke detector produces an audible noise signal. a light source suitably placed to identify a room or rooms where danger most likely exists is energized to produce a flashing light for quick room identification. The flashing light source should be bright enough to draw attention to it so that rescuers and others will know which areas to search first. When more than one of the present flashing light devices are used in the same home or building. it is possible to have a smoke detector device activate one or more flashing light devices. This can be done by including radio frequency transmitting means in the smoke detector. In this case an antenna would be installed on the alarm device instead of having microphones and the RF signals would be applied to the amplifier instead of output of the microphone. Thus. when the smoke detector activates. it will emit radio signals along with the audio signals which can be received by all the flashing light devices to cause them to activate.

Typically. the flashing light source will be mounted on or near an outside window or at some other highly visible place. and the smoke detector will be mounted near enough to the flashing light source and its associated circuit so that there is little or no chance that the circuit will not be able to respond to an audible smoke detector signal. Although it is contemplated to have the flashing light and its associated detection circuit constructed as separate units for mounting apart from each other. possibly even in different rooms under some circumstances. it is also contemplated and in most cases it is preferred to have the light source and its circuit combined in a common housing. The important thing is that the circuit for the flashing light be located so as to be able to respond to and be activated by audible signals produced by the smoke detector and so that its operation does not depend on any other signal or circuit condition to be activated. By so providing. the chances for failure are greatly reduced.

The present invention which resides mainly in the circuit for the light source has its own power source. such as an inexpensive nine volt battery. which circuit. when not responding to a smoke detector signal, continuously supplies a small trickle of energy to the light activation and signal detection circuit. usually to an operational amplifier (Op-Amp) circuit which is thereby maintained in a ready condition. The amplifier circuit typically draws a small amount of current. in the range from about two to five microamperes, which is not enough to represent a substantial drain on the battery except over a very long time period such as a year or longer.

By providing his small trickle of charge constantly to the amplifier circuit. the amplifier is kept in a constantly ready condition and this is an important and significant advantage in that it maintains the circuit so that as soon as the smoke detector activates, the audible signal produced will cause the flashing light also to activate without delay and without requiring periodic circuit testing. This also means that only one condition. namely detection of activation of a smoke detector. need take place for the flashing light alarm to commence flashing. This, in turn. means that the light source will start to flash sooner after smoke is detected than would be the case with known devices such a those discussed above.

With the present device. the input of the Op-Amp generally is connected through a filter circuit to the output of a microphone which responds to audio signals produced by a smoke detector, and the amplifier produces an output whenever the microphone senses such a signal. The output of the amplifier is connected to the input of a bandpass filter designed to pass signals having a frequency within some predetermined range. The outputs of the bandpass filter are applied as inputs to a detector circuit which converts the alternating filter outputs to a direct current (d.c.) signal which is used to activate or close a switching device. When the switch is closed, it completes a circuit between a timer circuit, a power source and a light source, which causes the light source to flash. The timer circuit controls the flashing rate or frequency of the light source.

As soon as the smoke detector is activated by smoke, the light source of the present device will immediately commence flashing to indicate to outsiders including potential rescuers which room or rooms are the ones where help is needed. These are the rooms where there are children, disabled persons or others in need of help. The present device may optionally also include an on-off switch connected into the circuit between the power source and amplifier to enable the user to control when power is to be supplied to the circuit. This can be done to save battery power when the room is not occupied and enables the user to turn the device off when the reasons for using it no longer exist.

It is an object of the present invention to provide novel means to energize a light source in response to an audio or other noise signal including also a radio frequency signal produced by a smoke detector.

Another object is to produce an easily recognizable flashing light signal to identify locations where a hazardous condition may exist.

Another object is to flash a light whenever a smoke detector responds to a dangerous or potentially dangerous condition to make it easy to locate rooms where people may be in danger.

Another object is to minimize risk of failure in a device which includes a signal responsive control circuit and a light source under control thereof.

Another object is to teach the construction of a device capable of producing a flashing light alarm condition, which device requires relatively little energy to remain in an active standby condition.

Another object is to minimize time lapses between when an alarm condition is sensed by a device such as a smoke detector and when a flashing light warning condition is produced.

Another object is to provide a relatively simple flashing alarm giving device controlled by signals such as noise signals produced when a smoke detector is set off by sensing a dangerous or potentially dangerous condition.

Another object is to provide a device for producing a flashing warning which can be mounted on or adjacent to a window such as an outside window to serve as a beacon for rescuers.

These and other objects and advantages of the present invention will become apparent to those skilled in the art after considering the following detailed specification of a preferred embodiment in conjunction with the accompanying drawings.

DETAILED DESCRIPTION OF THE INVENTION

Figure 1:
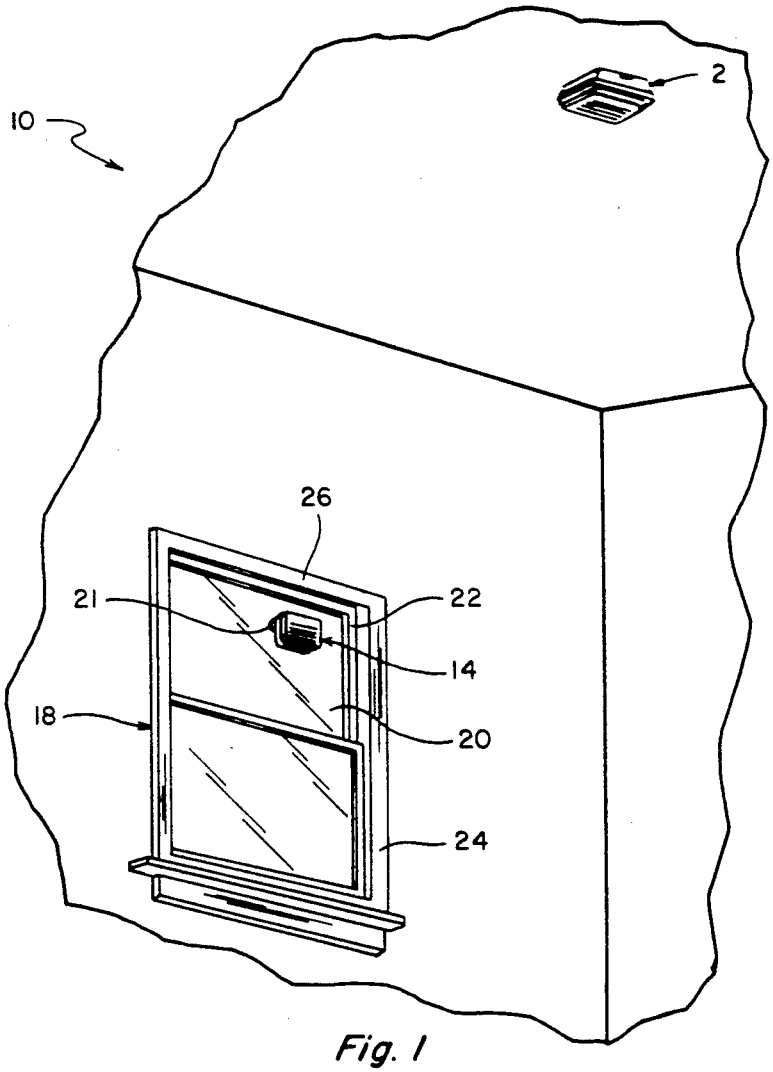
FIG. 1 is a perspective view of a part of a room equipped with an alarm system including a smoke detector and one embodiment of the present flashing alarm constructed according to the present invention.

Referring to the drawings more particularly by reference numbers wherein like numbers refer to like components, FIG. 1 shows a portion of a room equipped with an alarm system 10 constructed according to the present invention. The alarm system 10 includes a smoke detector 12 which ma be of conventional construction and is capable, when smoke or fire is detected, of producing an easily recognizable audio signal, usually of relatively high frequency. Such signals are usually irritating noise signals intended to attract attention and action. The smoke detector is shown installed on the ceiling usually at a central location in the room although any convenient location can be used.

Figure 1A:
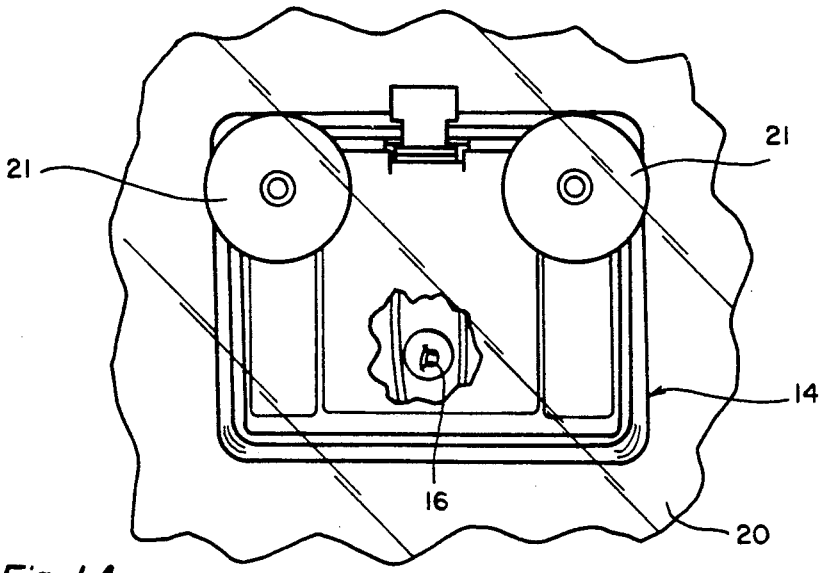
FIG. 1A is a fragmentary view from outside of a window pane having the flashing alarm mounted thereon.

The system 10 also includes a flashing alarm portion 14 which is shown mounted on or adjacent to a window, preferably an external window. The alarm 14 has a light bulb 16 mounted thereon or therein in position to produce visable light outside the room whenever it is energized. The alarm 14 can be mounted on a window 18 such as by being attached to window pane 20 using one or more suction cup devices 21, as shown in FIG. 1A, or it can be attached or mounted in some other way as by being attached to the window frame 22 or jamb 24 using threaded fastener means or the like. The device could even be suspended on a cord or wire from the upper frame member 26, if desired. The important thing is that the bulb 16 be visible from outside the room and that the alarm be located in close enough proximity to the smoke detector 12 to be able to respond to the noise signals produced thereby. It is also contemplated to mount the smoke detector in the same housing as the alarm although this is usually not preferred unless the device can be located in an area where the presence of fire or smoke is best detected.

Figure 2:
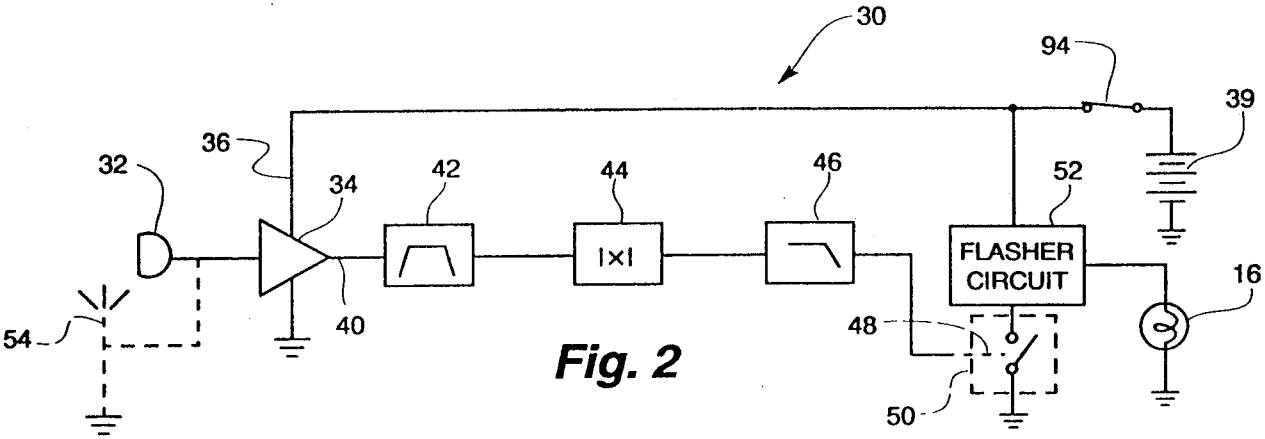
FIG. 2 is a block diagram of the circuit for the alarm producing portion of the system of FIG. 1, an alternate embodiment shown in dotted outline.

FIG. 2 is a block diagram of the circuit 30 for the flashing alarm portion 14 of the present system. The circuit includes a microphone 32 capable of responding to the noise signals produced by the smoke detector 12. The microphone 32 produces outputs which are applied to the input of an amplifier circuit through a filter circuit, shown as operational amplifier 34 (Op-Amp), which has a power input connection 36 to a battery or multiple battery power supply 38. This power connection is important because it means the amplifier 34 will be maintained in a constantly ready condition. The amplifier 3 and the battery 38 also have ground connections as shown. The output 40 of the amplifier 34 is connected to a band pass filter circuit 42 which has its output connected to a detector circuit 44 which in turn is connected to a low pass filter circuit 46. The output of the low pass filter circuit 46 is connected to a control electrode or gate 48 of a switching device 50 which may be a electronic switching device such as a MOSFET, an SCR or some other like switching device.

The switch 50 is connected in series with a timer circuit 52 and the battery 38. The timer 52 is in turn connected to ground through the light source 16. The frequency of the timer circuit 52 depends on the time constant thereof. The time constant should be selected to produce a light flashing rate that attracts attention and indicates an emergency, the idea being to produce a suitable warning that will attract rescuers or persons who can offer or seek help.

It is important to the operation of the present system as indicated that the Op-Amp circuit 34 receive a constant trickle of current from the battery 38 so that it is maintained in a constant ready condition. This means that whenever the microphone 32 responds to a smoke detector noise signal, the amplifier will immediately produce an output to cause the switching circuit 50 to close and to thereby activate the timer 52 to cause the light 16 to flash on and off. The timer, not the switch, flashes the light 16 but the timer is only able to flash the light when the switch 50 is closed. This is to be contrasted with other circuits which require several different things to take place before an alarm condition can be produced. This also means that with the present system there is less that can go wrong to cause a failure while at the same time the circuit in standby condition draws relatively little current and hence can operate for a very long time even a year or longer without losing power.

Many variations of the block diagram circuit shown in FIG. 2 are possible and contemplated. For example, the amplifier 34 could be integrated into the microphone 32, in which case power could be supplied directly to the microphone 32. Another possibility, as aforesaid, is to include a radio transmitter in the smoke detector and receiver means including an antenna such as antenna 54 (FIG. 2) in the flashing light unit so that if the smoke detector activates, it will transmit radio frequency signals that can be received by any alarm device in range thereof. The receiver means would operate the circuit in a manner similar to the microphone by causing the switch 48 to close and activate the circuit of the timer 52 and the light bulb 16. One advantage of using RF transmissions is that it may substantially increase the range that ca be used between the smoke detector and the alarm device. In fact, they may even be located in different rooms.

Figure 3:
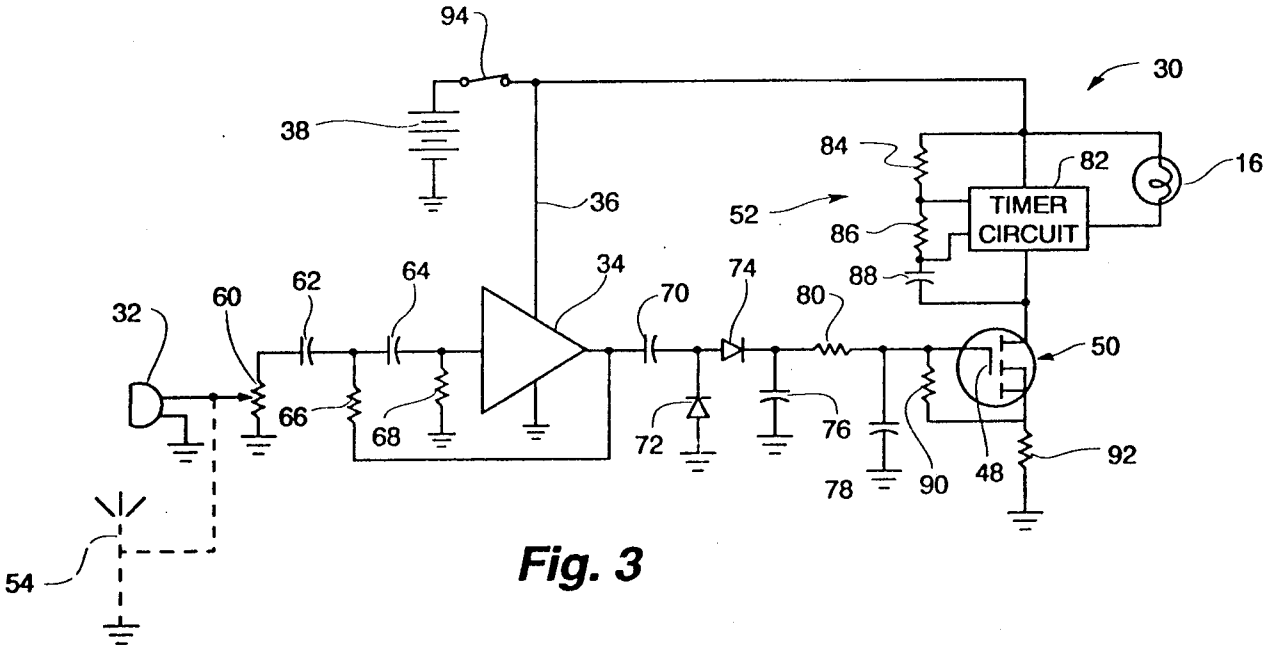
FIG. 3 is a schematic circuit diagram showing in more detail the circuit of FIG. 2.

FIG. 3 shows more circuit details of the present device including showing the microphone 32 (or antenna 54) connected to an amplifier input circuit which includes a sensitivity control potentiometer 60, and an input filter circuit formed of capacitors 62 and 64 and resistors 66 and 68 connected as shown. Another capacitor 70 for the band pass filter 42 has its output side connected to the detector circuit 44 formed by diodes 72 and 74. The output side of the detector 44 is connected to the low pass filter 46 formed of capacitors 76 and 78 and resistor 80. The output of the filter 46 is connected to the gate or base electrode 48 of the MOSFET 50. Biasing resistors 90 and 92 are connected to the MOSFET 50.

The timer circuit 52 includes a timer device 82 connected to resistors 84 and 86 and capacitor 88 as shown. The light 16 is also connected between the power source or battery 38 and the output 89 of the timer device 82. The timer device 82 may be in the form of an integrated circuit which operates in conjunction with the resistors 84 and 86 and the capacitor 88 as a stable multivibrator or flasher circuit. Since the MOSFET 50 is in the power supply path of the flasher or timer circuit 52, the light 16 can only be energized to flash when the MOSFET 50 is on or closed. This can only occur when an audible signal of a frequency that matches the frequency range of the band pass filter 42 is present and is of sufficient magnitude to reach the trigger potential of the MOSFET. The signal must be present for a long enough duration to allow the low pass filter 46 to pass it on to the MOSFET.

As indicated above only the amplifier circuit 34 and the timer or flasher circuit 52 draw power or are able to draw power from the battery 38, the amplifier circuit 34 drawing power continuously and the timer circuit 52 drawing power only when a smoke detector signal is detected. The purpose of the Op-Amp circuit 34 is to amplify the signals it receives, which are relatively small signals produced by the microphone 32 or in the antenna 54, to a level sufficient to make the detector circuit activate the MOSFET switching circuit 50. If the MOSFET is in its conducting condition it will ground the timer circuit 52. The timer circuit 52, as stated, is connected to the power source and when the MOSFET 50 conducts, power is supplied to the lamp 16 under control of the timer circuit 52. The timer circuit operates to cause the lamp to flash on and off to provide the desired warning. Thus, it can be seen that once an audible signal is detected by the microphone, the amplifier and the associated circuitry determines whether the signal is within a proper acceptable frequency range, and if it is, converts the signal to direct current (d.c.) and utilizes the signal to activate the lamp. By minimizing the time between when the smoke detector signal is detected and when the lamp begins to flash, it allows faster and hopefully, earlier identification of rooms in which persons, such as small children, may be located, and this may result in the saving of life.

The use of a crystal, a ceramic or a condenser microphone capable of responding to audible signals even over a fairly great distance is preferred and the magnitude of responses that are sufficient to cause an alarm condition is controlled by the setting of the potentiometer 60. The potentiometer 60 therefore allows the sensitivity of the system to be adjusted as desired. The capacitors 62 and 6 and the resistors 66 and 68 in conjunction with potentiometer 60 and the amplifier 34 provide a bandpass filtering function which eliminates responses that are not in the desired frequency range. This feature reduces the likelihood of false alarms. A desired amplifier for this purpose is a simple voltage Op-Amp having a constant gain factor. For example, a gain factor of 1000, means that a 1 millivolt rms input from the microphone 32 will appear as a 1000 millivolt (or 1 volt) rms signal. The other amplifier connections provide a ground reference and a power connection. Importantly, as stated, with the connections as shown, some amount of power is always provided to the amplifier 34 from the power source. Also, as stated, the Op-Amp 34 typically will draw between about 2 to 5 microamperes when in standby, and this amount of power will not adversely effect the power source except over a very long time period.

It is anticipated that the circuits shown in FIGS. 2 and 3 will be mounted on a printed circuit board using circuit construction and connection techniques well known in the art. A manual switch 94 may be provided to cut off all battery power to conserve energy when there is no reason to operate the device.

Thus, there has been shown and described a novel warning light system for use with smoke detectors and the like which fulfills all of the objects and advantages sought therefor. It will be apparent to those skilled in the art, however, that many changes, modifications, variations and other uses and applications for the subject device are possible and contemplated, and all such changes, modifications, variations and other uses and applications which do not depart from the spirit and scope of the invention are deemed to be covered by the invention which is limited only by the claims which follow.

What is claimed is:

1. A warning system for alerting a rescuer in the vicinity of a building of an emergency condition in the building and for indicating which opening of the building the rescuer should enter first, said system comprising:

a physically separate and distinct detector, said detector including an emergency condition sensing and signalling device for sensing smoke or fire in proximity of said detector and for signalling an emergency condition when smoke or fire is sensed;

a physically separate and distinct alarm device, said alarm device including sensing means for sensing the emergency condition signal generated by said emergency condition sensing device in the building;

an amplifier for receiving and amplifying said emergency condition signal after said signal is sensed by said sensing means and for producing an output signal;

generating means responsive to said output signal received from said amplifier for generating an intermittent light beam signal;

preventing means coupled between said amplifier and said generating means for preventing false signals from activating said light beam generating means, said preventing means including a bandpass filter;

ensuring means coupled between said amplifier and said generating means for ensuring that only emergency condition signals are supplied to said light beam generating means, said ensuring means including a low pass filter;

mounting means for mounting said device proximate to the building opening in a position to emit said intermittent light beam signal so it can be seen from outside the building.

2. The warning device of claim 1, wherein said emergency condition sensing device is a smoke detector.

3. The warning device of claim 1, wherein said emergency condition sending device is a fire detector.

4. The warning device of claim 1, wherein said emergency condition signal is an audible signal.

5. The warning device of claim 1, wherein said emergency condition signal is a radio frequency signal.

6. The warning device of claim 1, wherein said sensing means comprises a microphone for sensing an audible emergency condition signal.

7. The warning device of claim 1, wherein said sensing means comprises an antenna for sensing a radio frequency emergency condition signal.

8. The warning signal of claim 1 wherein said generating means for generating an intermittent light beam signal comprises a circuit including a power source, a timer circuit, and a switching device coupled in series, a light source is coupled to said timer circuit and an output of said ensuring means is coupled to said switching device.

9. The warning device of claim 8, wherein said timer circuit operates only when said switching device is closed by the sensing of said emergency condition signal and causes said light source to be energized intermittently.

10. The circuit of claim 8, wherein said switching device is a MOSFET.

11. The circuit of claim 8, wherein said switching device is a SCR.

12. The warning device of claim 1, wherein said mounting means comprises one or more suction cup devices capable of being mounted on a window pane.

13. The warning device of claim 1 wherein said preventing means comprises a bandpass filter for passing signals having a frequency within a predetermined frequency range of the emergency condition signal.

14. The warning device of claim 13 wherein said ensuring means comprises a detector circuit for rectifying the passed emergency condition signal and a low pass filter connected between said detector circuit and said generating means for passing to said light beam generating means direct current signals obtained from said passed emergency condition signal.

15. In a warning device responsive to emergency condition signals and having an input sensing circuit having an input and an output and an output circuit including a switching device and having an input and an output, the improvement comprising:

means for filtering out false signals and for ensuring the actuation of said warning device upon receiving bona fide emergency condition signals, said filtering means including an operational amplifier having an input coupled to the output of the input sensing circuit and an output, a bandpass filter having an output and an input coupled to the output of said operational amplifier for passing signals having a frequency within a predetermined range, a detector circuit having an output and an input coupled to the output of said bandpass filter for converting the passed signals into a direct current, and a low pass filter coupled to the output of said detector circuit and to the input of said output circuit for passing to the output circuit only those signals which are of sufficient magnitude and which are present for a long enough duration to allow them to pass through the low pass filter to the output of said switching device to activate the switching device.

16. In a warning system for alerting a rescuer in the vicinity of a building of an emergency condition in the building and for indicating which one of several openings to the building the rescuer should enter first, the improvement comprising:

a physically separate and distinct alarm device positioned in close proximity to an emergency sensing and signalling detector, said alarm device including sensing means for sensing an emergency condition signal generated by said emergency condition sensing and signalling detector;

an amplifier coupled to an output of said sensing means for amplifying said emergency condition signal after said signal is sensed by said sensing means;

a timer circuit and a light source, for generating an intermittent light beam signal;

a bandpass filter for passing signals having a frequency within a predetermined frequency range of the amplified emergency condition signal;

a detector circuit for rectifying the passed emergency condition signal and including a low pass filter for passing signals having a predetermined amplitude level coupled in series between the output of said sensing means and an input of said timer circuit;

said sensing means, said bandpass filter, said detector circuit and said low pass filter being coupled in series; and, mounting means for mounting said alarm device proximate to one of the building openings in position to emit said intermittent light beam signal so said intermittent light beam signal can be seen from outside the building.

17. The warning device of claim 16 wherein said mounting means comprises one or more suction cup devices capable of being mounted on a window pane.

18. The warning device of claim 16, wherein said emergency condition signal is a radio frequency signal and said sensing means comprises an antenna for sensing said radio frequency emergency condition signal.

* * * * *